US009371659B2

(12) United States Patent
Hernaiz

(10) Patent No.: US 9,371,659 B2
(45) Date of Patent: Jun. 21, 2016

(54) MOVING AND FLOATING POOL CLEANER APPARATUS

(71) Applicant: Maria Ignacia Hernaiz, Weston, FL (US)

(72) Inventor: Maria Ignacia Hernaiz, Weston, FL (US)

( * ) Notice: Subject to any disclaimer, the term of this patent is extended or adjusted under 35 U.S.C. 154(b) by 548 days.

(21) Appl. No.: 13/759,773

(22) Filed: Feb. 5, 2013

(65) Prior Publication Data

US 2013/0206659 A1 Aug. 15, 2013

Related U.S. Application Data

(60) Provisional application No. 61/597,541, filed on Feb. 10, 2012.

(51) Int. Cl.
*E04H 4/12* (2006.01)
*E04H 4/16* (2006.01)

(52) U.S. Cl.
CPC ..... *E04H 4/1263* (2013.01); *E04H 4/1654* (2013.01)

(58) Field of Classification Search
None
See application file for complete search history.

(56) References Cited

U.S. PATENT DOCUMENTS 3,508,661 A * 4/1970 Gershman et al. ..... 210/167.12
3,758,276 A * 9/1973 Bond et al. ..... 422/265
4,820,411 A * 4/1989 Lempio ..... 210/167.2
4,839,063 A * 6/1989 Brooks ..... 210/780

* cited by examiner

*Primary Examiner* — Bobby Ramdhanie
*Assistant Examiner* — Donovan C Bui-Huynh

(57) ABSTRACT

A moving and floating pool cleaner apparatus includes a circular cap, a basket, a floating container, an attachment tube, and a T-shaped adapter. The moving and floating pool cleaner apparatus attaches with an existing automatic pool cleaner, and cleans the surface of the pool water by removing all of the floating debris. The circular cap is attached to the floating container, and the floating container is attached with the automatic pool cleaner through the attachment tube and the T-shaped adapter. The basket is positioned within the floating container. The pool water with floating debris goes into the floating container and then to the basket, where the basket retains bigger particles while the pool water redirects into the attachment tube. Then the pool water is forwarded into a pool cleaning unit so that the pool water can be thoroughly cleaned before pumps back into the pool.

13 Claims, 16 Drawing Sheets

MOVING AND FLOATING POOL CLEANER APPARATUS

The current application claims a priority to the U.S. Provisional Patent application Ser. No. 61/597,541 filed on Feb. 10, 2012.

FIELD OF THE INVENTION

The present invention relates generally to a pool cleaning apparatus. More specifically, the present invention allows a user to effectively clean the surface of the pool water while the present invention is attached with an existing automatic pool cleaner.

BACKGROUND OF THE INVENTION

The present day pool skimmers are found in above-ground pools and inside-ground pools. The above-ground pools have at least one faceplate that is attached to the wall of the pool, where the at least one faceplate functions as the pool skimmer. The inside-ground pools also have pool skimmers, where the pool skimmers are set into a beam in the concrete outer wall. The pool skimmers in the inside-ground pools are difficult to remove and modify. The present day pool skimmers are able to catch and remove debris, when the debris moves close to the pool skimmers. The existing mobile skimmers are managed by hand and need human intervention or complex and expensive electronic parts, such as remote controls and solar system.

As a solution, the present invention provides a pool skimmer which requires no external power or energy source. The present invention has no moving components or electric components, and the present invention attaches with an existing automatic pool cleaner in order to clean the surface of the pool water. Since there are no moving components and no external power or energy source, the present invention does not have a self-propulsion system and uses the propulsion system of the automatic pool cleaner. The present invention provides an affordable solution to clean the surface water of the pool while saving time and money for the pool owner. The present invention also provides an effective alternative for pools without wall skimmers or a complement to current inside-ground pools. Since the present invention cleans the water surface simultaneously with the automatic pool cleaner, the users of the pool can always access a clean pool without any floating particles or debris.

DETAIL DESCRIPTIONS OF THE INVENTION

All illustrations of the drawings are for the purpose of describing selected versions of the present invention and are not intended to limit the scope of the present invention.

Figure 1:
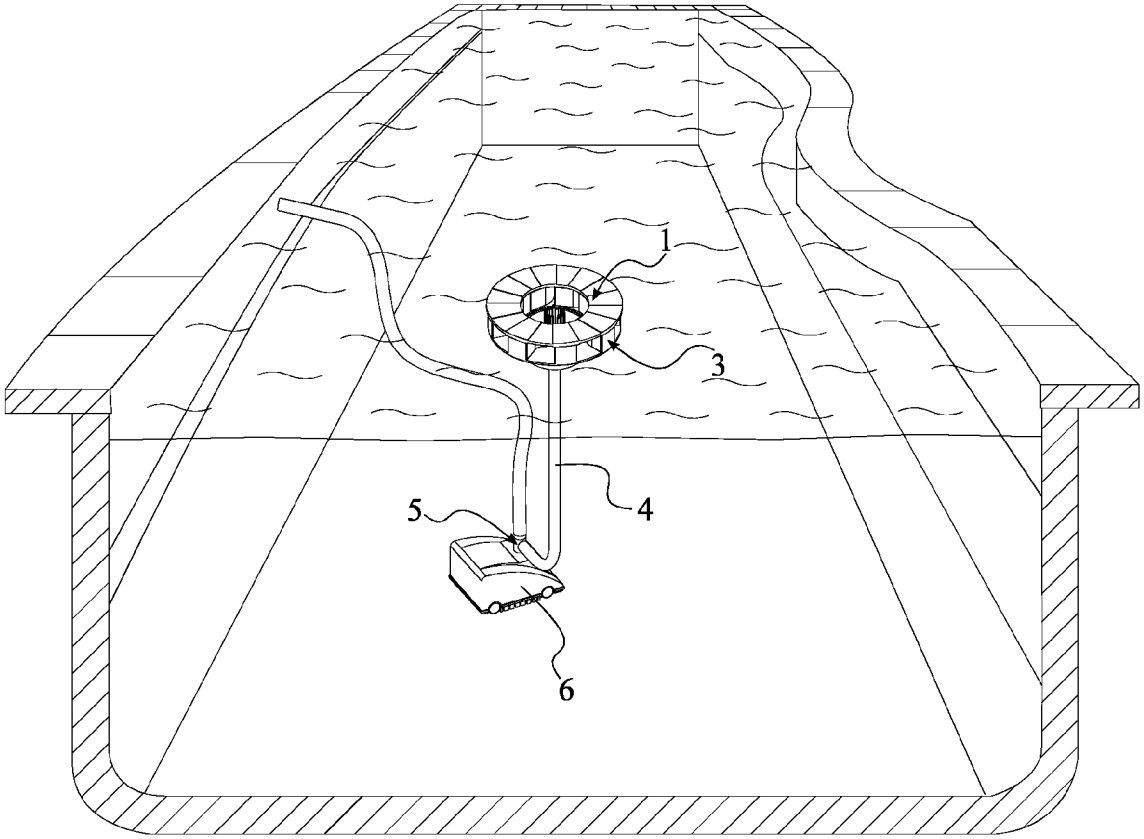
FIG. 1 is a perspective view of the present invention, wherein the present invention is positioned within a pool.
Figure 2:
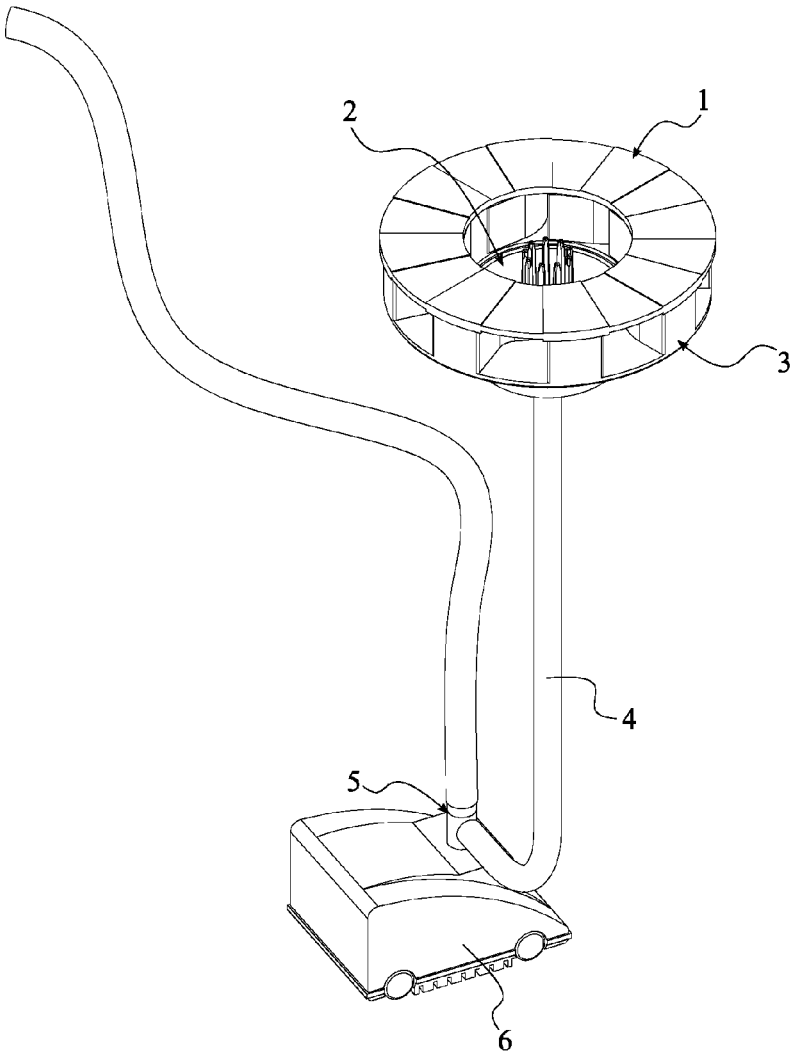
FIG. 2 is a perspective view of the present invention with an automatic pool cleaner.

The present invention is a pool skimmer which simultaneously moves and cleans the surface water of the pool along with an existing automatic pool cleaner 6. In reference to FIG. 1, FIG. 2, and FIG. 3, the present invention comprises a circular cap 1, a basket 2, a floating container 3, an attachment tube 4, and a T-shaped adapter 5. The basket 2 is positioned within the floating container 3, and the circular cap 1 is concentrically attached with the floating container 3. The floating container 3 attaches with the automatic pool cleaner 6 through the attachment tube 4 and the T-shaped adapter 5. Since the present invention is attached with the automatic pool cleaner 6, the present invention is able to clean the surface of the pool water while the automatic pool cleaner 6 cleans the pool floor and the pool walls. The surface pool water is sucked into the present invention and redirected to a pool cleaning unit, where the surface water of the pool is cleaned and rerouted back into the pool.

Figure 4:
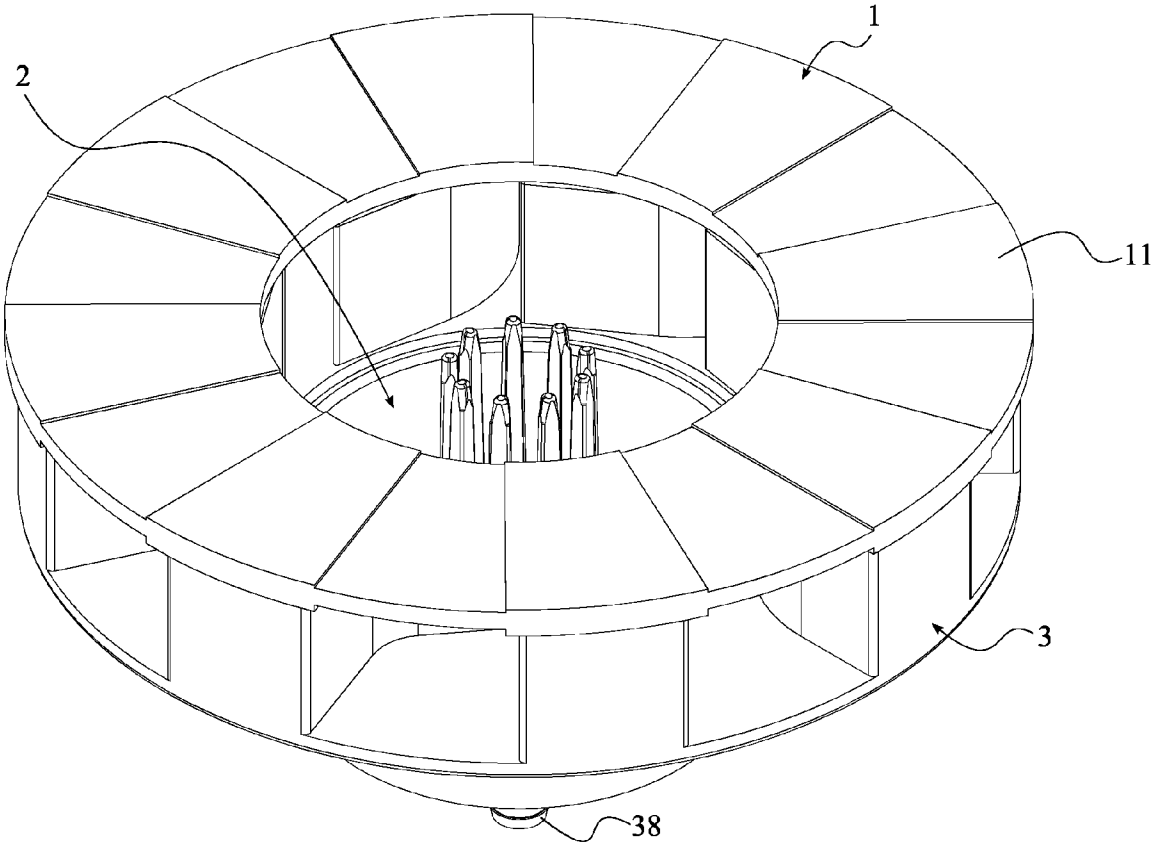
FIG. 4 is a perspective view of a circular cap, a basket, and a floating container of the present invention.
Figure 5:
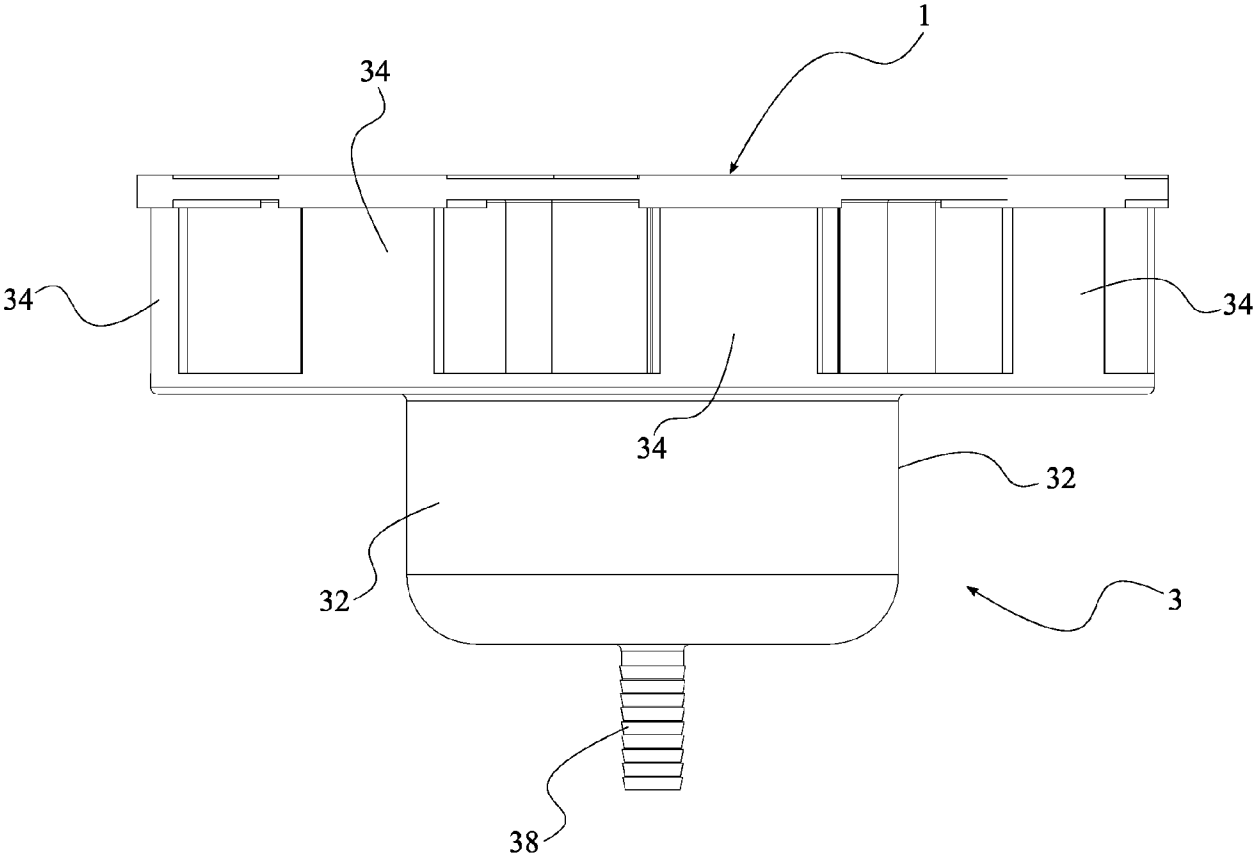
FIG. 5 is a front view of the circular cap, the basket, and the floating container of the present invention.
Figure 6:
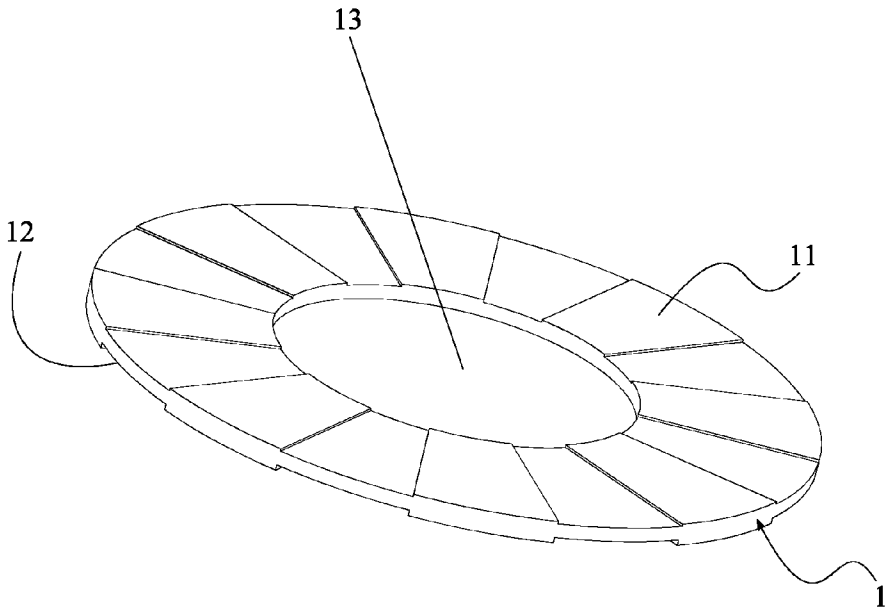
FIG. 6 is a perspective view of the circular cap of the present invention.

In reference to FIG. 4, FIG. 5, and FIG. 6, the circular cap 1 comprises a top surface 11, a bottom surface 12, and a cavity 13. The top surface 11 and the bottom surface 12 are oppositely positioned from each other, where the top surface 11 faces toward the surrounding area of the present invention, and the bottom surface 12 faces toward the present invention. The cavity 13, which also comprises a circular shape, is traversed through the top surface 11 and the bottom surface 12 and concentrically positioned within the circular cap 1. The circular cap 1 provides protection to the floating container 3 while functions as an ornamental cover the present invention. The circular cap 1 is made from rigid, high strength, and non-corrosive materials, such as plastic or composite materials, to maximize the life span of the circular cap 1. The bottom surface 12 may comprise snap fit edges or any other type of similar attachment mechanisms so that the circular cap 1 can be removably attached to the floating container 3.

Figure 9:
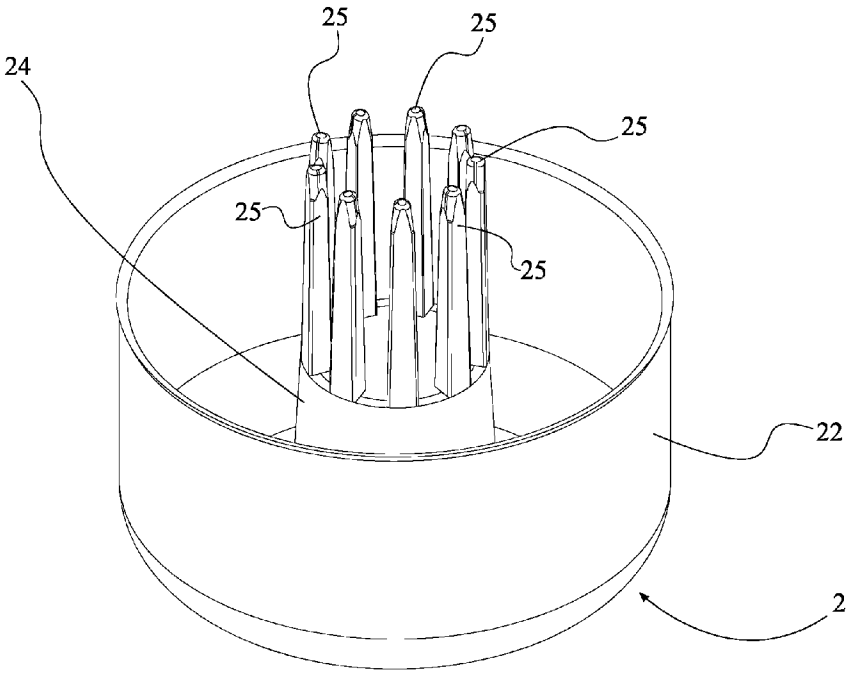
FIG. 9 is a perspective view of the basket of the present invention.
Figure 10:
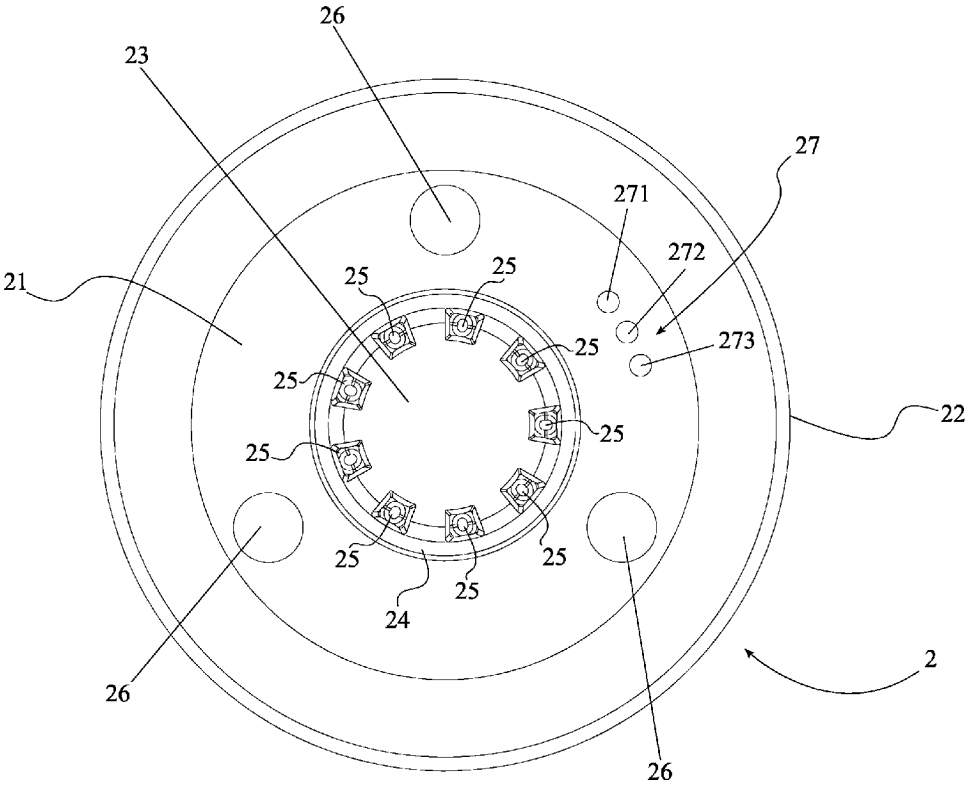
FIG. 10 is a top view of the basket of the present invention.

In reference to FIG. 9 and FIG. 10, the basket 2 comprises a basket base 21, a basket lateral wall 22, a first suction opening 23, a cylinder 24, a plurality of protrusions 25, pressure regulating gaps 26, and pressure setting holes 27. The basket lateral wall 22 is perimetrically positioned around the basket base 21, where the basket base 21 has a circular shape.

The first suction opening 23 is concentrically positioned trough the basket base 21. The cylinder 24, which is has a hollow body, is positioned above the basket base 21 and within the basket lateral wall 22, where the cylinder 24 is concentrically positioned with the first suction opening 23. The cylinder 24 is adjacently connected with the basket base 21, where the cylinder 24 comprises a larger bottom diameter and a smaller top diameter. The lager bottom diameter is adjacently positioned with the first suction opening 23 while the smaller top diameter is positioned opposite from the larger bottom diameter. The larger bottom diameter and the smaller top diameter create a tapered shape into the cylinder 24. The smaller top diameter positions below a top rim of the basket lateral wall 22. The plurality of protrusions 25 is vertically positioned atop the cylinder 24, where each of the plurality of protrusions 25 extends from the smaller top diameter. Each of the plurality of protrusions 25 is equally spaced from each other along the smaller top diameter and extends above the top rim of the basket lateral wall 22. The plurality of protrusions 25 on a preferred embodiment of the present invention includes nine protrusions, although any desired number of protrusions can be used. The pressure regulating gaps 26, which traverse through the basket base 21, are equally spaced and radially positioned around the first suction opening 23. The pressure setting holes 27 are radially positioned around the first suction opening 23 and positioned in between at least two gaps of the pressure regulating gaps 26. The basket 2 is made from rigid, high strength, and non-corrosive materials, such as plastic or composite materials, to maximize the life span of the basket 2.

Figure 7:
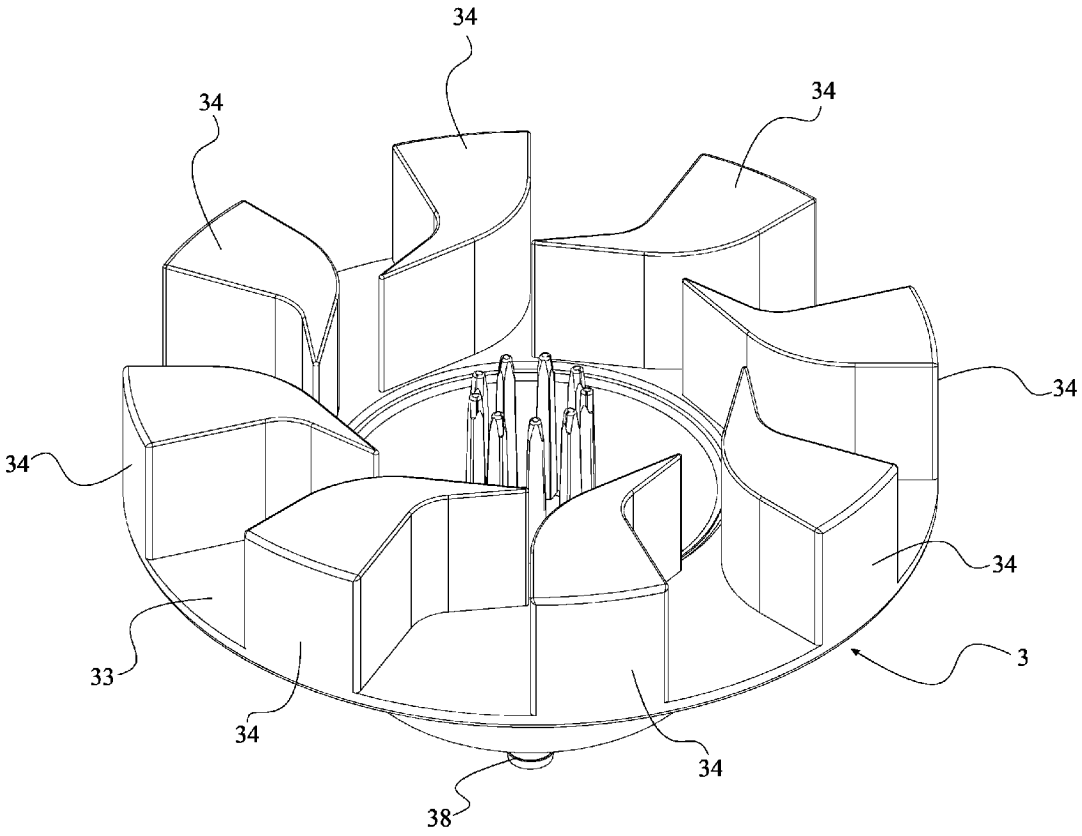
FIG. 7 is a perspective view of the basket and the floating container of the present invention.
Figure 8:
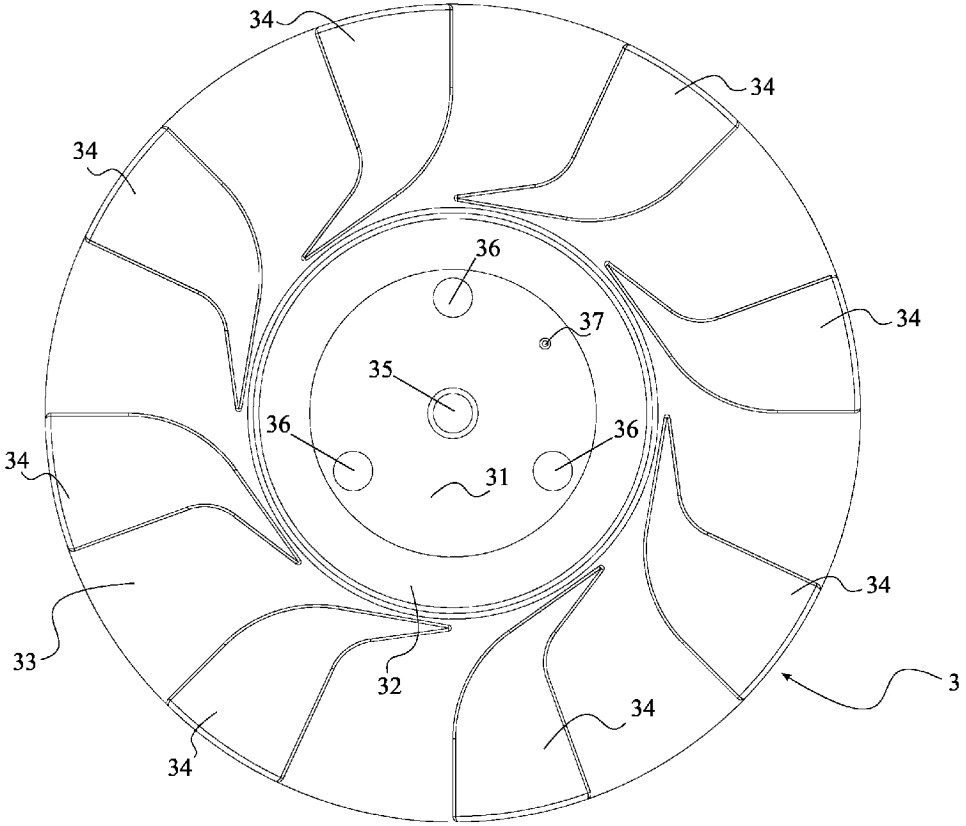
FIG. 8 is a top view of the floating container of the present invention.
Figure 13:
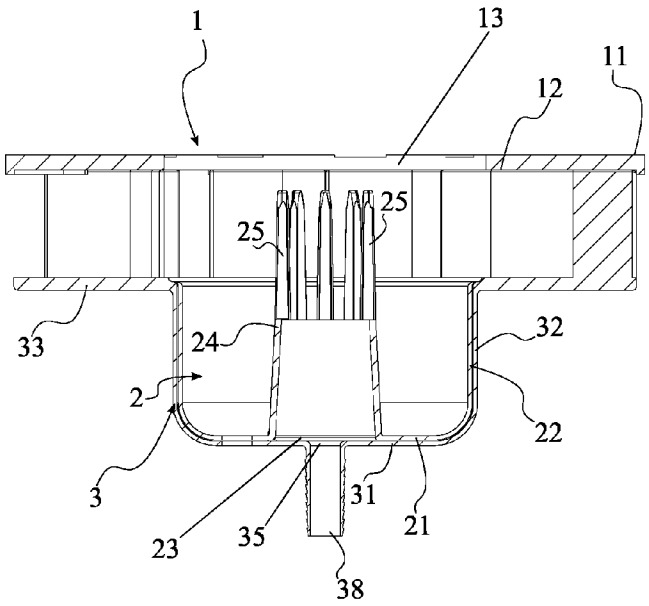
FIG. 13 is a cross section view of the present invention taken along line A-A of FIG. 12.
Figure 12:
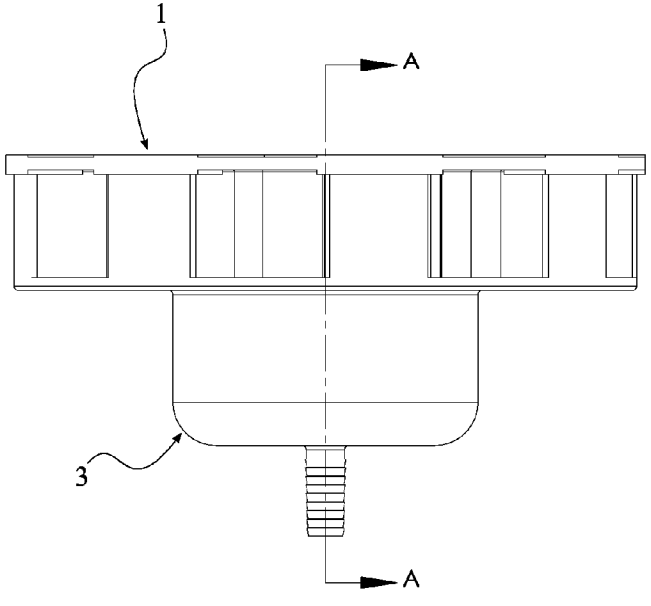
FIG. 12 is a front view of the circular cap, the basket, and the floating container of the present invention, showing the plane upon which a cross sectional view is taken shown in FIG. 13.
Figure 17:
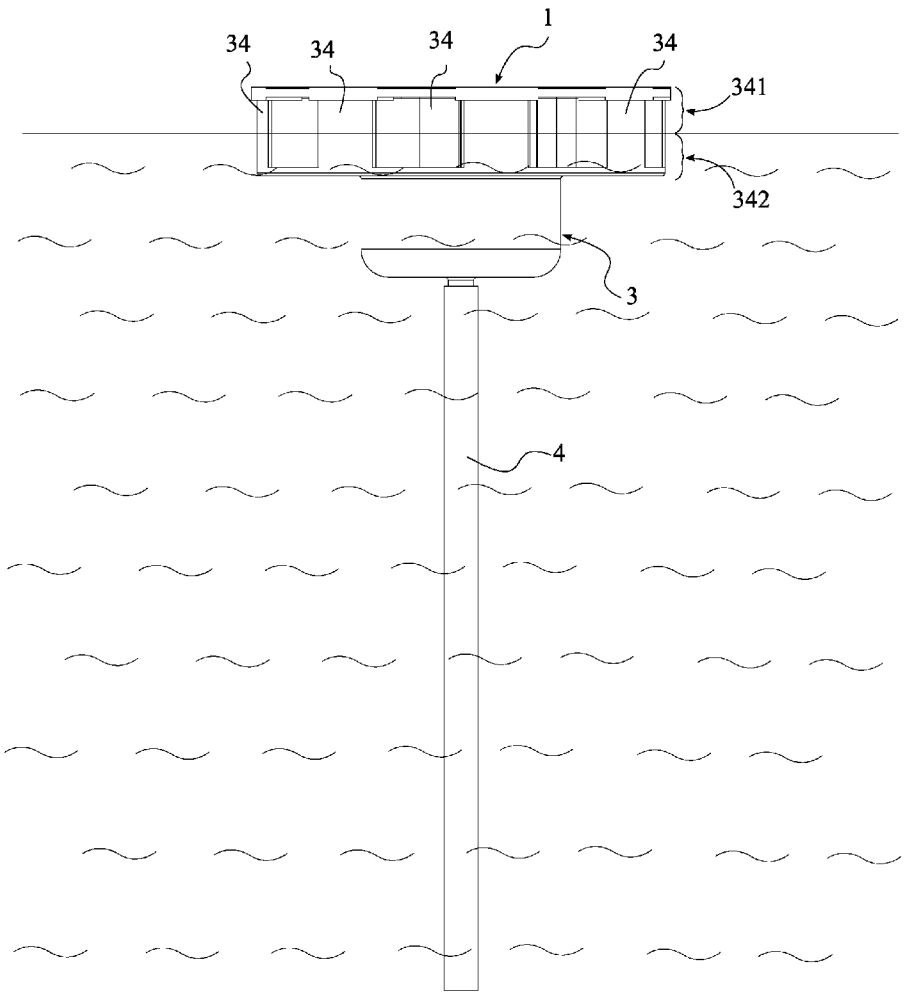
FIG. 17 is a side view of the circular cap, the basket, the floating container, and an attachment tube of the present invention, wherein the present invention is floating on the water.

In reference to FIG. 7 and FIG. 8, the floating container 3 comprises a container base 31, a container lateral wall 32, a top plate 33, a plurality of guides 34, a second suction opening 35, pressure regulating openings 36, a locking pin 37, and a hose fitting 38. The container lateral wall 32 is perimetrically positioned around the container base 31, and the container base 31 has a similar shape as the basket base 21. In reference to FIG. 12 and FIG. 13, since the basket 2 is positioned within the floating container 3, the basket base 21 and the container base 31 are adjacently positioned next to each other, and the basket lateral wall 22 is adjacently positioned within the container lateral wall 32. The top plate 33 is oppositely positioned from the container base 31, where the top plate 33 is positioned parallel with the container base 31 and perimetrically positioned around the container lateral wall 32. A top edge of the container lateral wall 32 is adjacently positioned with an inner diameter of the top plate 33, and the top plate 33 extends from the inner diameter to an outer diameter of the top plate 33. The plurality of guides 34 is radially positioned around the top plate 33 in between the inner diameter and the outer diameter. As shown in the FIG. 17, the size of the plurality of guides 34 allows the present invention floats at a desired floatation level, where a lower half 342 of the plurality of guides 34 is submerged in the water, and an upper half 341 of the plurality of guides 34 is positioned above the water level. The shape of the plurality of guides 34 allows the surface pool water to enter into the floating container 3, but does not allow the water to escape from the floating container 3 whether the present invention is moving with the automatic pool cleaner 6 or placed stationary. The second suction opening 35, which is smaller than the first suction opening 23 and the smaller top diameter, is concentrically positioned through the container base 31. Since the basket 2 is positioned within the floating container 3, the second suction opening 35 is concentrically positioned below the first suction opening 23, where both the first suction opening 23 and the second suction opening 35 are linearly aligned with each other. The pressure regulating openings 36, which traverse through the container base 31, are equally spaced and radially positioned around the second suction opening 35. The size and shape of the pressure regulating openings 36 are identical to the pressure regulating gaps 26 so that proper pressure regulation can take place within the present invention. The locking pin 37 is radially positioned with the second suction opening 35 and connected to the container base 31. The hose fitting 38 is oppositely positioned from the locking pin 37 and concentrically positioned with the second suction opening 35, where the hose fitting 38 is adjacently connected with the container base 31. The hose fitting 38 includes a plurality of barbs as the plurality of barbs provides a secure connection to the attachment tube 4. The floating container 3 is made from rigid, high strength, and non-corrosive materials, such as plastic or composite materials, to maximize the life span of the floating container 3.

Figure 14:
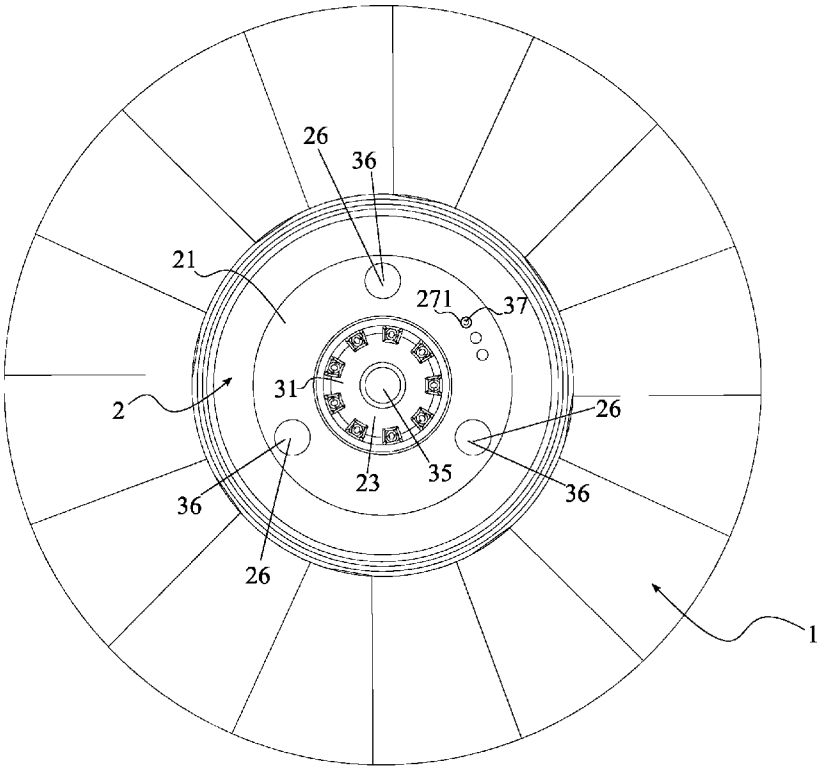
FIG. 14 is a top view of the present invention, showing a minimum power setting.
Figure 15:
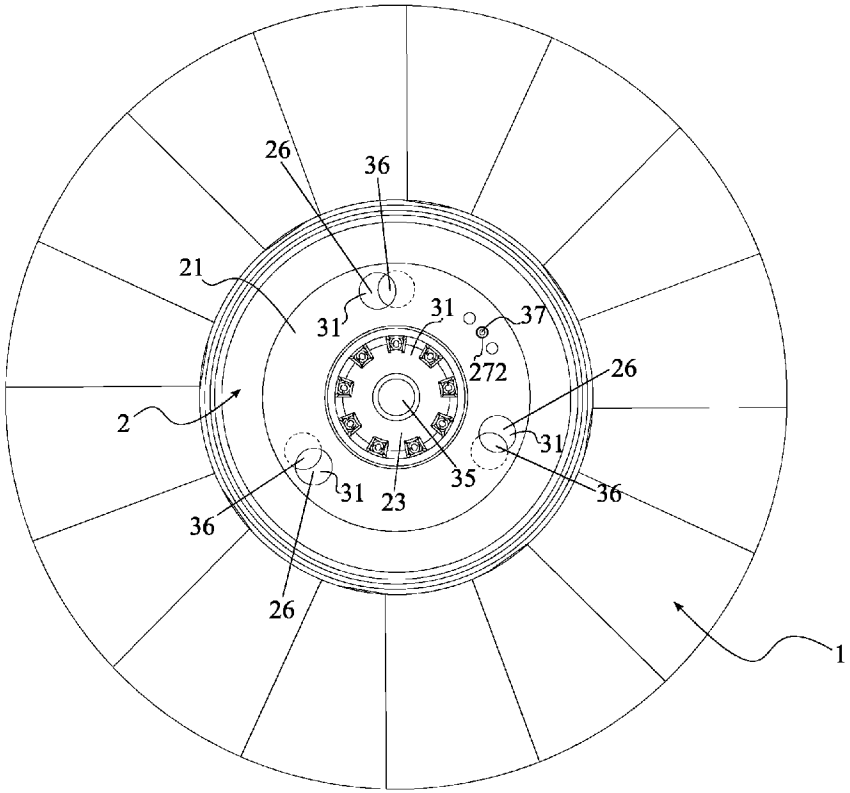
FIG. 15 is a top view of the present invention, showing an intermediate power setting, wherein the dash line are illustrating pressure regulating openings of the floating container.
Figure 16:
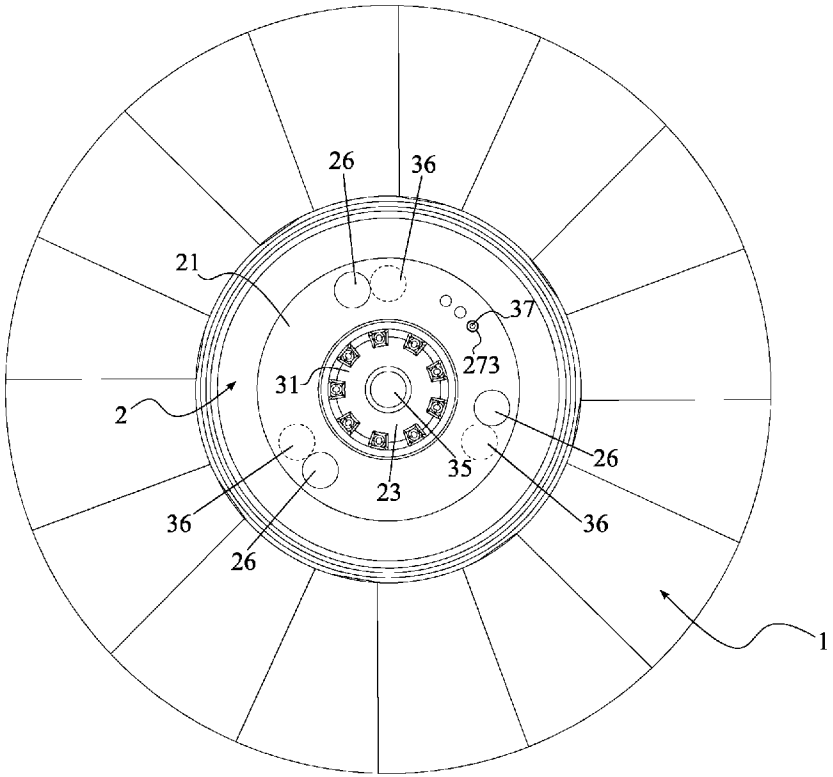
FIG. 16 is a top view of the present invention, showing a maximum power setting, wherein the dash line are illustrating the pressure regulating openings of the floating container.

The basket 2 can be easily removed from the floating container 3 or inserted into the floating container 3 through the cavity 13 of the circular cap 1 so that the basket 2 can be cleaned or adjusted according to a correct power setting for optimal performance, where the correct power setting mainly depends on the vacuum force of the pool cleaning unit and the cleanliness of the filtration system in the pool cleaning unit. The basket 2 securely locks in place within the floating container 3 upon insertion because of the locking pin 37 and the pressure setting holes 27, as the locking pin 37 traverses through one of the pressure setting holes 27. In reference to FIG. 10, the pressure setting holes 27 in the preferred embodiment comprises a first hole 271, a second hole 272, and a third hole 273. In reference to FIG. 14, when the locking pin 37 is traversed through the first hole 271, the pressure regulating gaps 26 concentrically align with the pressure regulating openings 36. Since the pressure regulating gaps 26 and the pressure regulating openings 36 are fully opened, a minimum power setting is obtained within the present invention. In reference to FIG. 15, when the locking pin 37 is traversed through the second hole 272, the pressure regulating gaps 26 partially align with the pressure regulating openings 36. Since the pressure regulating gaps 26 and the pressure regulating openings 36 are partially opened, an intermediate power setting is obtained within the present invention. In reference to FIG. 16, when the locking pin 37 is traversed through the third hole 273, the pressure regulating gaps 26 position away from the pressure regulating openings 36. Since the pressure regulating gaps 26 and the pressure regulating openings 36 are fully closed because of the basket base 21 and the container base 31, a maximum power setting is obtained within the present invention.

Figure 3:
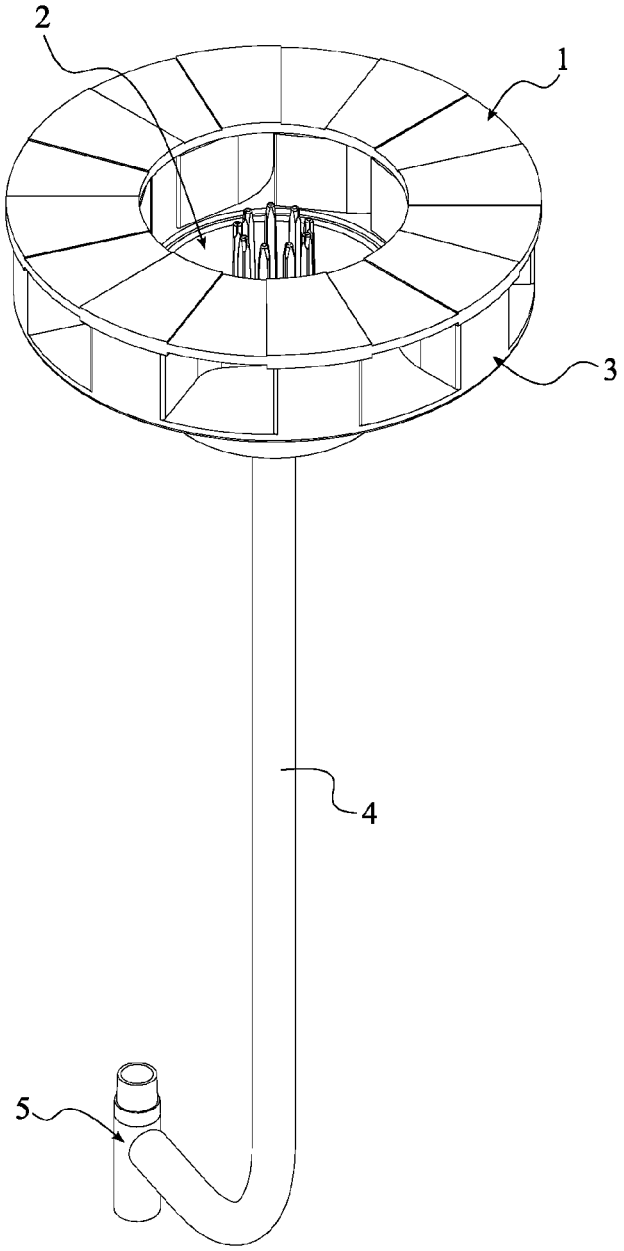
FIG. 3 is a perspective view of the present invention.

In reference to FIG. 3, the attachment tube 4 is positioned in between the floating container 3 and the T-shaped adapter 5, where the attachment tube 4 is connected to the hose fitting 38 of the floating container 3. Length of the attachment tube 4 is chosen with sufficient length to keep the present invention floating on top of the water while allowing the present invention to freely move along with the automatic pool cleaner 6. The attachment tube 4 is made from flexible and non-corrosive materials, such as rubber or plastic, to maximize the life span of the attachment tube 4 and to attain the optimal performance of the present invention.

Figure 11:
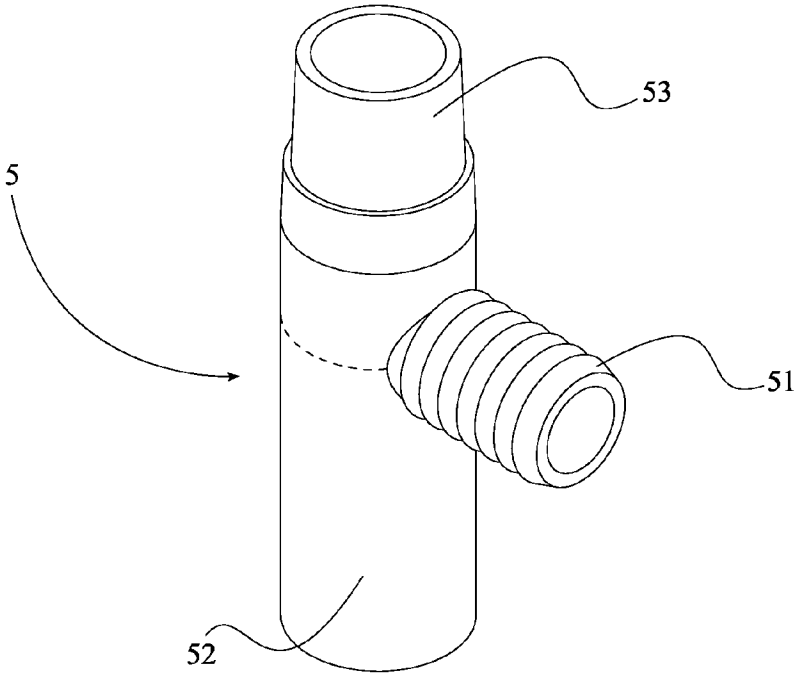
FIG. 11 is a perspective view of a T-shaped adapter of the present invention.

In reference to FIG. 11, the T-shaped adapter 5 is a hollow body which comprises a vacuum hose fitting section 51, a pool cleaner fitting section 52, and an attachment tube fitting section 53. Each of the vacuum hose fitting section 51, the pool cleaner fitting section 52, and the attachment tube fitting section 53 comprises an opening, where the dimensions of the opening are calculated, so that the present invention operates without compromising the mobility and the power of the automatic pool cleaner 6. The T-shaped adapter 5 creates a connection port so that the present invention can be attached in between the automatic pool cleaner 6 and a vacuum hose of the pool cleaning unit since the automatic pool cleaner 6 and the vacuum hose is interconnected to each other. The vacuum hose fitting section 51 and the pool cleaner fitting section 53 are oppositely positioned from each other. The attachment tube fitting section 53 is positioned in between the vacuum hose fitting section 51 and the pool cleaner fitting section 53 and perpendicularly positioned with the vacuum hose fitting section 51 and the pool cleaner fitting section 53. The attachment tube 4 is inserted around the attachment tube fitting section 53. The attachment tube fitting section 53 further comprises a plurality of ridges, where the plurality of ridges prevents the attachment hose from slipping away from the attachment tube fitting section 53. In order to complete the connection port, the pool cleaner fitting section 53 is attached with the automatic pool cleaner 6, and the vacuum hose fitting section 51 is attached with the vacuum hose. The 90 degree angle between the attachment tube fitting section 53 and the vacuum hose fitting section 51 separate the attachment tube 4 from the vacuum hose, avoiding them being tangled up with each other. The T-shaped adapter 5 is made from rigid, high strength, and non-corrosive materials, such as plastic or composite materials, to maximize the life span of the T-shaped adapter 5.

When the present invention is attached to the automatic pool cleaner 6, and the automatic pool cleaner 6 is turned on, the present invention starts to clean the surface of the pool water. When the present invention floats on the surface of the pool water, both the circular cap 1 and the upper half 341 of the plurality of guides 34 are completely positioned above the surface of the pool water and the plurality of protrusions 25 are partially extended out from the surface of the pool water. Since the vacuum hose creates a void inside the T-shaped adapter 5, the surface pool water is pulled into the present invention so that the cleaning process can take place. Guide openings, which are positioned in between each of the plurality of guides 34, allow the surface pool water to enter into the floating container 3. Then the surface pool water and any kind floating debris are pulled into the basket 2 with the suction power of the vacuum hose. Since the second suction opening 35 is smaller than the first suction opening 23 and the smaller top diameter, the cylinder 24 creates a whirlpool effect to the surface pool water within the basket 2, but the placement and the shape of the plurality of guides 34 initiate the creation of the whirlpool effect. The whirlpool effect enables the present invention to fully function within the specifications of the present invention while using minimum amount of suction power from the vacuum hose. If the surface pool water contains large sized debris, the large sized debris impacts with the plurality of protrusions 25 and falls into the basket base 21, but all of the small sized debris in the surface pool water flows into the cylinder 24 through the plurality of protrusions 25. Because of the plurality of protrusions 25, the present invention is able to keep the large sized debris out of the basket 2 so that the attachment tube 4 does not get clog. The basket 2 needs to be clean periodically to get rid of the buildup of the large sized particles to optimize the efficiency of the present invention. The surface pool water is then pulls out from the cylinder 24 through the first suction opening 23 and the second suction opening 35 by the attachment tube 4, where the surface pool water is redirected into the vacuum hose through the T-shaped adapter 5. Then the surface pool water goes through the standard pool cleaning process within the pool cleaning unit and pumps back into the pool. As the automatic pool cleaner 6 moves around the pool, the present invention also follows the automatic pool cleaner 6 while cleaning the surface of the pool water.

The present invention can be used as a fixed system if the automatic pool cleaner 6 is not available. In order to use the present invention as the fixed system, the present invention is attached with the vacuum hose through a reduction adapter instead of the T-shaped adapter 5. The present invention is designed base of a mathematical calculus based on the product shape & material weight, which allow the present invention to have the desired floatation level in the middle of the guide openings according to the Archimedes principle, allowing the absorption of water around the present invention's perimeter. The mathematical calculus consider the suction force of the vacuum hose, buoyant force exerted on the present invention, and other forces that impact the entire system of the present invention.

Although the invention has been explained in relation to its preferred embodiment, it is to be understood that many other possible modifications and variations can be made without departing from the spirit and scope of the invention as hereinafter claimed.

What is claimed is:

1. A moving and floating pool cleaner apparatus comprises:

a circular cap;

a basket;

a floating container;

an attachment tube;

a T-shaped adapter;

the circular cap comprises a top surface, a bottom surface, and a cavity;

the basket comprises a basket base, a basket lateral wall, a first suction opening, a cylinder, a plurality of protrusions, pressure regulating gaps, and pressure setting holes;

the floating container comprises a container base, a container lateral wall, a top plate, a plurality of guides, a second suction opening, pressure regulating openings, a locking pin, and a hose fitting;

the T-shaped adapter comprises a vacuum hose fitting section, a pool cleaner fitting section, and an attachment tube fitting section;

the basket being positioned within the floating container;

the circular cap being concentrically attached to the floating container;

the floating container being adapted to attach to an automatic pool cleaner via the attachment tube and the T-shaped adapter and redirect water thereto;

the basket being adapted to be removably inserted into the floating container of the cavity;

a length of the attachment tube is selected to be greater than a swimming pool depth;

the T-shaped adapter having a hollow body;

the T-shaped adapter comprising a vacuum hose fitting section, a pool cleaner fitting section, and an attachment tube fitting section;

a vacuum hose fitting section comprises an opening of the vacuum hose fitting section;

the pool cleaner fitting section comprises an opening of the pool cleaner fitting section;

the attachment tube fitting section comprises and opening of the attachment tube fitting section;

the top surface and the bottom surface being oppositely positioned from each other;

the cavity having a circular shape and traversed through the top surface and the bottom surface;

the top surface being outwardly facing;

the bottom surface concentrically positioned within the circular cap;

the bottom surface comprises snap fit edges removably engaging the floating container;

the cavity being concentrically positioned within the circular cap;

the basket lateral wall being perimetrically positioned around the basket base;

the first suction opening being concentrically positioned through the basket base;

the cylinder being positioned atop the basket base and within the basket lateral wall;

the cylinder being concentrically positioned with the first suction opening and adjacently connected with the basket base;

the plurality of protrusions being vertically positioned atop the cylinder;

the cylinder being adjacently connected with the basket base;

the cylinder comprising bottom diameter and a top diameter, the bottom diameter being larger than the top diameter;

the bottom diameter being adjacently positioned with the first suction opening;

the top diameter being positioned opposite the larger bottom diameter;

the bottom diameter and the top diameter creating a tapered shape into the cylinder;

the top diameter being positioned below a top rim of the basket lateral wall;

each of the plurality of protrusions extending from the top diameter;

the plurality of protrusions being equally spaced along the top diameter and extending above the top rim of the basket lateral wall;

the number of protrusions being nine;

the pressure regulating gaps being radially positioned around the first suction opening and traversed through the basket base;

the pressure regulating gaps being equally spaced around the suction opening;

the pressure setting holes being radially positioned around the first suction opening and positioned in between at least two gaps of the pressure regulating gaps;

the container lateral wall being perimetrically positioned around the container base;

the top plate being positioned parallel with the container base;

the top plate being perimetrically positioned around the container lateral wall;

the plurality of guides being radially positioned around the top plate;

the second suction opening being concentrically positioned through the container base;

the pressure regulating openings being radially positioned around the second suction opening;

the locking pin being radially positioned with the second suction opening and positioned on the container base;

the hose fitting being oppositely positioned from the locking pin and concentrically positioned with the second suction opening;

the hose fitting being adjacently connected to the container base;

the hose fitting having a plurality of barbs, the plurality of barbs securing the hose fitting to the attachment tube;

a top edge of the container lateral wall being adjacently positioned within an inner diameter of the top plate, the top plate extending from the inner diameter to the outer diameter of the top plate;

the plurality of guides radially positioned around the top plate in between the inner diameter and outer diameter;

a size of the plurality of guides determining a floatation level of the pool cleaner apparatus;

a lower half of the plurality of guides adapted to be submerged in water;

an upper halve of the plurality of guides adapted to be positioned above water;

a shape of the plurality of guides adapted to allow surface pool water to enter the floating container, and is configured to not allow water to escape from the floating container;

the second suction opening and the top diameter being concentrically positioned through the container base;

the second suction opening being concentrically positioned below the first suction opening, the first suction opening and the second suction opening being linearly aligned;

the pressure regulating openings being equally spaced and radially positioned around the second suction openings;

a size of the pressure regulating openings being identical to a size of the pressure regulating gaps;

a shape of the pressure regulating openings being identical to a shape of the pressure regulating gaps; and the attachment tube fitting section comprising a plurality of ridges, the plurality of ridges preventing the attachment hose from slipping away from the attachment tube fitting section.

2. The moving and floating pool cleaner apparatus as claimed in claim 1 comprises:

the basket base being adjacently positioned with the container base;

the basket lateral wall being adjacently positioned within the container lateral wall;

the first suction opening being concentrically positioned with the second suction opening;

the locking pin being inserted through one of the pressure setting holes; and the bottom surface being attached to the plurality of guides.

3. The moving and floating pool cleaner apparatus as claimed in claim 2 comprises:

the locking pin being inserted through a first hole of the pressure setting hole; and the pressure regulating gaps being concentrically aligned with the pressure regulating openings.

4. The moving and floating pool cleaner apparatus as claimed in claim 2 comprises:

the locking pin being inserted through a second hole of the pressure setting hole; and the pressure regulating gaps being partially aligned with the pressure regulating openings.

5. The moving and floating pool cleaner apparatus as claimed in claim 2 comprises:

the locking pin being inserted through a third hole of the pressure setting hole; and the pressure regulating gaps being positioned away from the pressure regulating openings.

6. The moving and floating pool cleaner apparatus as claimed in claim 1 comprises:

the attachment tube being positioned in between the hose fitting and the T-shaped adapter; and the attachment tube being inserted around the hose fitting.

7. The moving and floating pool cleaner apparatus as claimed in claim 1 comprises:

the vacuum hose fitting section and the pool cleaner fitting section being oppositely positioned from each other;

the attachment tube fitting section being positioned in between the vacuum hose fitting section and the pool cleaner fitting section;

the attachment tube fitting section being perpendicularly positioned with the vacuum hose fitting section and the pool cleaner fitting section;

the attachment tube being inserted around the attachment tube fitting section;

the pool cleaner fitting section being attached with an existing automatic pool cleaner; and the vacuum hose fitting section being attached with a vacuum hose of a pool cleaning unit.

8. A moving and floating pool cleaner apparatus comprises:

a circular cap;

a basket;

a floating container;

an attachment tube;

a T-shaped adapter;

the circular cap comprises a top surface, a bottom surface, and a cavity;

the basket comprises a basket base, a basket lateral wall, a first suction opening, a cylinder, a plurality of protrusions, pressure regulating gaps, and pressure setting holes;

the floating container comprises a container base, a container lateral wall, a top plate, a plurality of guides, a second suction opening, pressure regulating openings, a locking pin, and a hose fitting;

the T-shaped adapter comprises a vacuum hose fitting section, a pool cleaner fitting section, and an attachment tube fitting section;

the basket being positioned within the floating container;

the circular cap being concentrically attached to the floating container;

the floating container being adapted to attach to an automatic pool cleaner via the attachment tube and the T-shaped adapter and redirect water thereto;

the basket being adapted to be removably inserted into the floating container of the cavity;

a length of the attachment tube is selected to be greater than a swimming pool depth;

the T-shaped adapter having a hollow body;

the T-shaped adapter comprising a vacuum hose fitting section, a pool cleaner fitting section, and an attachment tube fitting section;

a vacuum hose fitting section comprises an opening of the vacuum hose fitting section;

the pool cleaner fitting section comprises an opening of the pool cleaner fitting section;

the attachment tube fitting section comprises and opening of the attachment tube fitting section;

the top surface and the bottom surface being oppositely positioned from each other;

the cavity having a circular shape and traversed through the top surface and the bottom surface;

the top surface being outwardly facing;

the bottom surface concentrically positioned within the circular cap;

the bottom surface comprises snap fit edges removably engaging the floating container;

the cavity being concentrically positioned within the circular cap;

the basket lateral wall being perimetrically positioned around the basket base;

the first suction opening being concentrically positioned through the basket base;

the cylinder being positioned atop the basket base and within the basket lateral wall;

the cylinder being concentrically positioned with the first suction opening and adjacently connected with the basket base;

the plurality of protrusions being vertically positioned atop the cylinder;

the cylinder being adjacently connected with the basket base;

the cylinder comprising bottom diameter and a top diameter, the bottom diameter being larger than the top diameter;

the bottom diameter being adjacently positioned with the first suction opening;

the top diameter being positioned opposite the larger bottom diameter;

the bottom diameter and the top diameter creating a tapered shape into the cylinder;

the top diameter being positioned below a top rim of the basket lateral wall;

each of the plurality of protrusions extending from the top diameter;

the plurality of protrusions being equally spaced along the top diameter and extending above the top rim of the basket lateral wall;

the number of protrusions being nine;

the pressure regulating gaps being radially positioned around the first suction opening and traversed through the basket base;

the pressure regulating gaps being equally spaced around the suction opening;

the pressure setting holes being radially positioned around the first suction opening and positioned in between at least two gaps of the pressure regulating gaps;

the container lateral wall being perimetrically positioned around the container base;

the top plate being positioned parallel with the container base;

the top plate being perimetrically positioned around the container lateral wall;

the plurality of guides being radially positioned around the top plate;

the second suction opening being concentrically positioned through the container base;

the pressure regulating openings being radially positioned around the second suction opening;

the locking pin being radially positioned with the second suction opening and positioned on the container base;

the hose fitting being oppositely positioned from the locking pin and concentrically positioned with the second suction opening;

the hose fitting being adjacently connected to the container base;

the hose fitting having a plurality of barbs, the plurality of barbs securing the hose fitting to the attachment tube;

a top edge of the container lateral wall being adjacently positioned within an inner diameter of the top plate, the top plate extending from the inner diameter to the outer diameter of the top plate;

the plurality of guides radially positioned around the top plate in between the inner diameter and outer diameter;

a size of the plurality of guides determining a floatation level of the pool cleaner apparatus;

a lower half of the plurality of guides adapted to be submerged in water;

an upper halve of the plurality of guides adapted to be positioned above water;

a shape of the plurality of guides adapted to allow surface pool water to enter the floating container, and is configured to not allow water to escape from the floating container;

the second suction opening and the top diameter being concentrically positioned through the container base;

the second suction opening being concentrically positioned below the first suction opening, the first suction opening and the second suction opening being linearly aligned;

the pressure regulating openings being equally spaced and radially positioned around the second suction openings;

a size of the pressure regulating openings being identical to a size of the pressure regulating gaps;

a shape of the pressure regulating openings being identical to a shape of the pressure regulating gaps;

the attachment tube fitting section comprising a plurality of ridges, the plurality of ridges preventing the attachment hose from slipping away from the attachment tube fitting section;

the basket base being adjacently positioned with the container base;

the basket lateral wall being adjacently positioned within the container lateral wall;

the first suction opening being concentrically positioned with the second suction opening;

the locking pin being inserted through one of the pressure setting holes; and the bottom surface being attached to the plurality of guides.

9. The moving and floating pool cleaner apparatus as claimed in claim 8 comprises:

the locking pin being inserted through a first hole of the pressure setting hole; and the pressure regulating gaps being concentrically aligned with the pressure regulating openings.

10. The apparatus for moving and floating pool cleaner as claimed in claim 8 comprises:

the locking pin being inserted through a second hole of the pressure setting hole; and the pressure regulating gaps being partially aligned with the pressure regulating openings.

11. The moving and floating pool cleaner apparatus as claimed in claim 8 comprises:

the locking pin being inserted through a third hole of the pressure setting hole; and the pressure regulating gaps being positioned away from the pressure regulating openings.

12. The moving and floating pool cleaner apparatus as claimed in claim 8 comprises:

the attachment tube being positioned in between the hose fitting and the T-shaped adapter; and the attachment tube being inserted around the hose fitting.

13. The moving and floating pool cleaner apparatus as claimed in claim 8 comprises:

the vacuum hose fitting section and the pool cleaner fitting section being oppositely positioned from each other;

the attachment tube fitting section being positioned in between the vacuum hose fitting section and the pool cleaner fitting section;

the attachment tube fitting section being perpendicularly positioned with the vacuum hose fitting section and the pool cleaner fitting section;

the attachment tube being inserted around the attachment tube fitting section;

the pool cleaner fitting section being attached with an existing automatic pool cleaner; and the vacuum hose fitting section being attached with a vacuum hose of a pool cleaning unit.

* * * * *